US005821215A

United States Patent [19]

Crudden et al.

[11] Patent Number: 5,821,215

[45] Date of Patent: Oct. 13, 1998

[54] N-ACYL ETHYLENEDIAMINETRIACETIC ACID SURFACTANTS AS ENZYME COMPATIBLE SURFACTANTS, STABILIZERS AND ACTIVATORS

[75] Inventors: Joseph J. Crudden, Hudson; Joseph Lazzaro, Hampstead, both of N.H.; Brian A. Parker, Newlands, Ireland

[73] Assignee: Hampshire Chemical Corp., Lexington, Mass.

[21] Appl. No.: 637,575

[22] Filed: Apr. 25, 1996

[51] Int. Cl.[6] ..... C11D 3/386; C11D 33/33

[52] U.S. Cl. ..... 510/392; 510/393; 510/476; 510/480; 510/490; 510/530; 510/533

[58] Field of Search ..... 510/476, 480, 510/490, 533, 392, 530, 393

[56] References Cited

U.S. PATENT DOCUMENTS

| | | | |
|---|---|---|---|
| 3,956,164 | 5/1976 | Walker et al. | 252/180 |
| 4,595,527 | 6/1986 | Gipp | 252/546 |
| 4,636,327 | 1/1987 | Frenier et al. | 252/87 |
| 4,680,131 | 7/1987 | Busch et al. | 252/102 |
| 4,698,181 | 10/1987 | Lewis | 252/527 |
| 5,250,728 | 10/1993 | Parker et al. | 562/565 |
| 5,284,972 | 2/1994 | Parker et al. | 562/565 |
| 5,340,501 | 8/1994 | Steindorf | 252/546 |
| 5,466,394 | 11/1995 | de Buzzaccascin et al. | 252/547 |
| 5,621,008 | 4/1997 | Ptchelintseu | 514/561 |
| 5,688,981 | 11/1997 | Nonomura et al. | 556/116 |

OTHER PUBLICATIONS

Development of Detergent Enzymes; Christensen, et al. pp. 181–186.

European Laundry Powders–Trends Affecting Active Composition and Performance; Scowen, et al. pp. 81–88.

*Primary Examiner*—Kery Fries
*Attorney, Agent, or Firm*—Nields, Lemack & Dingman

[57] ABSTRACT

Compositions including one or more enzymes and as the compatible chelating surfactant, salts of N-acyl ethylenediaminetriacetic acid ("ED3A"). Salts of N-acyl ED3A do not readily denature various enzymes, and thus are highly compatible with such enzymes, and enhance their detergent effectiveness to an unexpected degree.

8 Claims, No Drawings

N-ACYL ETHYLENEDIAMINETRIACETIC ACID SURFACTANTS AS ENZYME COMPATIBLE SURFACTANTS, STABILIZERS AND ACTIVATORS

BACKGROUND OF THE INVENTION

Ethylenediaminetriacetic acid (ED3A) and its salts (such as its alkali metal salts, including $ED3ANa_3$) have applications in the field of chelating chemistry, and may be used as a starting material in the preparation of strong chelating polymers, oil soluble chelants, surfactants and others. Conventional routes for the synthesis of ethylenediaminetriacetic acid were achieved via its N-benzyl derivative, which was subsequently hydrolyzed in alkaline solutions to $ED3ANa_3$, thus avoiding cyclization to its 2-oxo-1,4-piperazinediacetic acid (3KP) derivative. One example of the synthesis of ethylenediamine-N,N,N'-triacetic acid is disclosed in *Chemical Abstracts* 78, Vol. 71, page 451, no. 18369c, 1969. There it is stated that ethylenediamine reacts with $ClH_2CCO_2H$ in a 1:3 molar ratio in basic solution at 10° C. for 24 hours to form a mixture from which ethylenediamine-N,N,N'-triacetic acid can be separated by complexing the same with Co(III). The resulting cobalt complexes can be isolated through ion exchange.

U.S. Pat. No. 5,250,728, the disclosure of which is hereby incorporated by reference, discloses a simple process for the synthesis of ED3A or its salts in high yield. Specifically, a salt of N,N'-ethylenediaminediacetic acid ($ED2AH_2$) is condensed with stoichiometric amounts, preferably slight molar excesses of, formaldehyde, at temperature between 0° and 110° C., preferably 0° to 65° C. and pH's greater than 7.0 to form a stable 5-membered ring intermediate. The addition of a cyanide source, such as gaseous or liquid hydrogen cyanide, aqueous solutions of hydrogen cyanide or alkali metal cyanide, in stoichiometric amounts or in a slight molar excess, across this cyclic material at temperatures between 0° and 110° C., preferably between 0° and 65° C., forms ethylenediamine N,N'-diacetic acid-N'-cyanomethyl or salts thereof (mononitrile-diacid). The nitrile in aqueous solutions may be spontaneously cyclized in the presence of less than 3.0 moles base: mole $ED2AH_2$, the base including alkali metal or alkaline earth metal hydroxides, to form 2-oxo-1, 4-piperazinediacetic acid (3KP) or salts thereof, which is the desired cyclic intermediate. In the presence of excess base, salts of ED3A are formed in excellent yield and purity. This patent also discloses an alternative embodiment in which the starting material is $ED2AH_aX_b$, where X is a base cation, e.g., an alkali or alkaline earth metal, a is 1 to 2, and b is 0 to 1 in aqueous solutions. The reaction mixture also can be acidified to ensure complete formation of carboxymethyl-2-oxopiperazine (the lactam) prior to the reaction. Formaldehyde is added, essentially resulting in the hydroxymethyl derivative. Upon the addition of a cyanide source, 1-cyanomethyl-4-carboxymethyl-3-ketopiperazine (mononitrile monoacid) or a salt thereof is formed. In place of $CH_2O$ and a cyanide source, $HOCH_2CN$, which is the reaction product of formaldehyde and cyanide, may also be employed in this method. Upon the addition of any suitable base or acid, this material may be hydrolyzed to 3KP. The addition of a base will open this ring structure to form the salt of ED3A.

U.S. Pat. No. 5,284,972, the disclosure of which is hereby incorporated by reference, discloses N-acyl ED3A derivatives and a process for producing the same. The production of N-acyl derivatives of ethylenediaminetriacetic acid can be accomplished according to the following general reaction scheme:

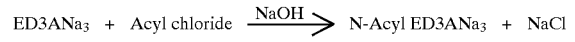

The starting ED3A derivative can be the acid itself, or suitable salts thereof, such as alkali metal and alkaline earth metal salts, preferably sodium or potassium salts.

Saturated N-Acyl ED3A derivatives that are the product of the foregoing reaction can be represented by the following chemical formula:

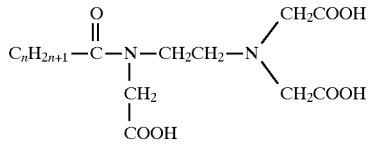

wherein n is from 1 to 40. Where unsaturation occurs, the structure may be shown as follows:

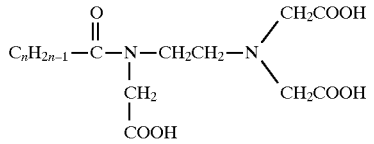

where n is from 2 to 40. As unsaturation increases, the formulae are:

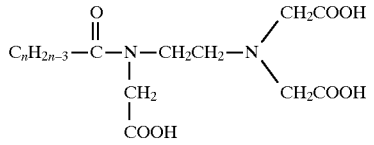

where n is 3 to 40;

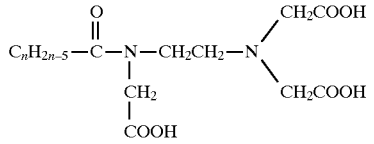

where n is 4 to 40; and

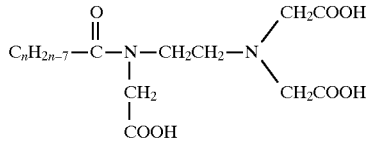

where n is 5 to 40, etc.

Poly N-acyl ethylenediaminetriacetic acid derivatives, such as dicarboxylic acid derivatives having the following general formula also can be produced:

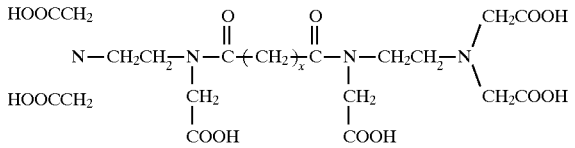

-continued or:

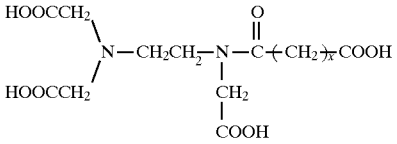

where x is 1 to 40. Specific examples include mono and di ED3A derivatives such as oxalyldi ED3A, oxalylmono ED3A, maleylmono ED3A, maleyldi ED3A, succinoylmono ED3A, succinoyldi ED3A, etc.

In view of this relatively new technology, ethylenediaminetriacetic acid (ED3A) and its salts now can be readily produced in bulk and high yield.

Enzymes, such as proteases, lipases and amylases, are commonly used to enhance the performance of fabric detergents, dish washing liquids, hard surface cleaners, drain opening fluids, etc. By using such an enzyme in a detergent, it is possible to hydrolyze the proteins or starch residues on fabrics to such a degree that they become readily soluble in water. Thus, a more effective removal of difficult protein or starch stains, including blood, mucus, and sweat, food products, etc. can be achieved. Moreover, since insoluble proteins and starches cause dirt to adhere strongly to fabrics, increasing the protein and starch solubility helps remove dirt as well. Commercial enzymes are produced mainly by living cells such as yeasts, and are proteinaceous in nature. Enzymes with enhanced activity for commercial use are often produced by genetic engineering.

The type of enzyme used depends on the detergent formulation and application conditions, especially since any given enzyme typically exhibits a maximum effectiveness at specific pH's and temperatures. Above their peak effectiveness temperature, they usually become denatured and never regain their activity. Enzymes are often denatured or deactivated by harsh surfactants such as sodium lauryl sulfate or linear alkyl benzene sulfate that are also common to detergent formulations. It is believed that this denaturing or deactivation is due to the disturbance of the three dimensional structure of the protein. Metal ions such as copper$^{+2}$, iron, nickel$^{+2}$, cobalt, etc. can also deactivate enzymes, possibly by interacting with and blocking the active site of the enzyme.

It is therefore an object of the present invention to provide enzyme compatible surfactants.

It is a further object of the present invention to provide detergent compositions containing an enzyme and an enzyme compatible surfactant.

It is an even further object of the present invention to enhance the detergent power of a detergent composition with an N-acyl ED3A surfactant that is compatible with the enzyme in the detergent composition.

SUMMARY OF THE INVENTION

The problems of the prior art have been overcome by the present invention, which provides compositions including one or more enzymes and one or more surfactants, provided that at least one of the surfactants is an N-acyl ethylenediaminetriacetic acid or salt thereof. Surprisingly, the present inventors have found that N-acyl ED3A is highly compatible with various enzymes, and enhances their detergent effectiveness to an unexpected degree. Thue use of such surfactants with other enzyme systems, such as industrial processes, is also contemplated.

DETAILED DESCRIPTION OF THE INVENTION

Suitable acyl groups in the N-acyl ED3A surfactant include straight or branched aliphatic or aromatic groups containing from 1 to 40 carbon atoms, such as pentanoyl, hexanoyl, heptanoyl, octanoyl, nananoyl, decanoyl, lauroyl, myristoyl, palmitoyl, oleoyl, stearoyl and nonanoyl. Examples of suitable branched acyl groups include neopentanoyl, neoheptanoyl, neodecanoyl, iso-octanoyl, iso-nananoyl and iso-tridecanoyl. Suitable aromatic acyl groups include benzoyl and napthoyl. The fatty acid chains may be substituted, such as by one or more halogen and/or hydroxyl groups. Examples of hydroxy-substituted fatty acids including ipurolic (3,11-dihyroxytetradecanoic), ustilic (2,15, 16-trihydroxyhexadecanoic), ambrettolic (16-hydroxy-7-hexadecanoic), ricinoleic (12-hydroxy-cis-9-octadecenoic), ricinelailic (12-hydroxy-trans-9-octadecenoic), 9,10-dihydroxyoctadecanoic, 12-hydroxyoctadecanoic, kaimlolenic (18-hydroxy-8,11,13-octadecatrienoic), ximenynolic (8-hydroxy-trans-1 1-octadecene-9-ynoic), isanolic (8-hydroxy-17-octadecene-9,11 -diynoic) and lequerolic) 14-hydroxy-cis-11-eicosenoic), as well as acyl derivatives of the above (the above named derivatives wherein the suffix "oic" is replaced by "oyl chloride"). Suitable halogen- substituted fatty acids include trifluoromethylbenzoyl chloride, pentadecafluorooctanoyl chloride, pentafluoropropionoyl chloride, pentafluorobenzoyl chloride, perfluorostearoyl chloride, perfluorononamoyl chloride, perfluoroheptanoyl chloride and trifluoromethylacetyl chloride. Preferably, the N-acyl group contains from 8 to 18 carbon atoms.

The surfactant properties of N-acyl ED3A molecules allow for dispersion of fatty soils and thus enhance the activity of lipases against fatty soils. As the interfacial tension between the aqueous phase and the oily phase is reduced, interfacial area is increased, allowing the enzyme in the aqueous phase more surface to attack, thereby increasing the rate of reaction. Enhanced wetting of soils allows for more efficient attack by the enzymes, such as proteases, on deposited proteinaceous soils.

In addition, the stability of N-acyl ED3A is not inhibited by the presence of excess electrolyte, such as sodium chloride, and multivalent hardness ions, such as $Ca^{++}$ and $Mg^{++}$. Surprisingly, the present inventors have found that such electrolytes and hardness ions actually significantly enhance the lather stability of alkali metal N-acyl ED3A. The ability of N-acyl ED3A to sequester transition and heavy metal ions also alleviates the potential for the enzyme activity to be reduced as a result of these ions.

The N-acyl ED3A is preferably used in the form of its salts, in view of their solubility. Where the N-acyl ED3A acid is first produced, it can be readily converted into salts by partial or complete neutralization of the acid with the appropriate base. The acid also can be produced from N-acyl ED3A salts by neutralization of the base with a quantitative amount of acid. The preferred chelating surfactants for use in the detergent compositions of the present invention are sodium and potassium lauroyl-ED3A. Other suitable counterions include triethanolamine, diethanolamine, monoethanolamine, ammonium, isopropyl amine, N-propylamine and amino alcohols such as 2-amino-1-butanol, 2-amino-2-methyl-1,3-propane diol, 2-amino-2-methyl-1-propanol, 2-amino-2-ethyl-1,3-propane diol and Tris(hydroxylmethyl) aminomethane.

The N-acyl ED3A salt can be used in the detergent compositions of the present invention alone or in combination with other surfactants. Preferably the total amount of surfactant in the composition is between about 5 to about 30%, more preferably from about 10 to about 25%, most preferably about 12%. The pH of the detergent composition depends in part on the particular enzyme being used, but generally is within a range of about 7 to about 12.

Suitable enzymes include proteolytic enzymes such as Alcalase•, Esperase•, Savinase•, and Durazym™, amylases such as Termamyl•, BAN, lipases such as Lipolase•, and cellulases. Savinase•, for example, is a serine protease having an optimum pH of 9–11 and an optimum temperature of 55° C. Avinase•, for example, has an optimum pH of about 6–8 and an optimum temperature of about 60° C. Lipases have the ability to decompose hydrophobic substances (such as hydrophobic triglycerides) into more hydrophilic compounds which are more easily removed by detergent action.

In addition to the surfactant, detergent formulations typically comprise about 13–25% builder, such as nitrilotriacetic acid, phosphates and zeolites. Up to about 25% bleach persalts also can be added. Conventional surfactants that may be used in combination with the N-acyl ED3A include anionics such as sarcosinates (including oleoyl, lauroyl and myristoyl), soluble linear alkylbenzene sulfonate, allyl sulfate and alkyl ethoxy sulfates, sodium lauryl ether sulfate; nonionics such as alcohol ethyoxylates and alkyl polyglycosides; cationics such as $C_{12}$–$C_{14}$ trimethyl ammonium chloride, di-tallow di-methyl ammonium chloride; and di-tallow methylamine, etc., and many of the foregoing are often used in combination, such as a binary mixture of linear alkylbenzene sulfonate and alcohol ethoxylates.

Other ingredients conventionally added to detergent compositions may be included, such as soap, dyes, perfumes, thickeners, conditioners, emollients, buffering agents, opacifiers, preservatives, optical brighteners, fabric softeners, etc.

Examples of suitable formulations are as follows:

| Traditional Type European Heavy Duty Detergent | |
|---|---|
| Sodium lauroyl ED3A | 5–20% |
| Nonionics | 1–7% |
| Sodium triphosphate | 0–30% |
| Zeolite | 0–35% |
| Sodium perborate/bleach activator | 10–25% |
| Sodium carbonate | 2–15% |
| Sodium silicate | 0–10% |
| Complexing agent | 0–1% |
| Polycarboxylates | 0–3% |
| Optical brighteners, perfume | 0.4–0.5% |
| Enzymes: | |
| Alcalase 2.0 T or | 0.4–0.8% |
| Durazym 6.0 T or | 0.3–0.8% |
| Esperase 4.0 T or | 0.4–0.8% |
| Savinase 6.0 T | 0.3–0.6% |
| Lipolase 100 T | 0.2–0.6% |
| Termamyl 60 T | 0.4–0.8% |
| Celluzyme 0.7 T | 1.0–3.0% |
| Sodium sulphate, water, etc. | Balance to 100% |
| pH | 9.5–10.5 |
| Compact Type Heavy Duty Detergent | |
| Sodium myristoyl ED3A | 5–35% |
| Nonionics | 1–15% |
| Sodium triphosphate | 0–40% |
| Zeolite | 0–40% |
| Sodium perborate/bleach activator | 15–30% |
| Sodium silicate | 2–10% |
| Sodium carbonate | 5–20% |
| Complexing agent (phosphonate, citrate) | 0–1% |
| Polycarboxylates | 0–3% |
| Optical brighteners, perfume | 0.4–0.6% |

-continued

| Enzymes: | |
|---|---|
| Durazym 6.0 T or | 0.6–1.5% |
| Esperase 4.0 T or | 0.6–1.5% |
| Savinase 6.0 T or | 0.6–1.5% |
| Lipolase 100 T | 0.3–0.8% |
| Termamyl 60 T | 0.2–1.0% |
| Celluzyme 0.7 T | 1.2–3.0% |
| Sodium sulphate, water, etc. | Balance to 100% |
| pH | 9.5–11 |
| Heavy Duty Liquid Detergent | |
| Triethanol amine oleoyl ED3A | 5–35% |
| Nonionics | 3–20% |
| Sodium triphosphate | 0–30% |
| Zeolite | 0–30% |
| Complexing agent (phosphonate, citrate) | 1–5% |
| Polycarboxylates | 0–5% |
| Optical brighteners, perfume | 0.1–0.5% |
| Enzymes: | |
| Alcalase 2.5 L or | 0.4–1.0% |
| Durazym 16.0 L or | 0.2–0.6% |
| Esperase 8.0 T or | 0.4–1.0% |
| Savinase 16.0 L or | 0.2–0.6% |
| Termamyl 300 L | 0.2–0.6% |
| Water | 30–50% |
| pH | 7.0–9.5 |
| Automatic Dishwashing Detergent | |
| Sodium myristoyl ED3A | 2–5% |
| Sodium triphosphate | 0–40% |
| Sodium perborate/bleach activator | 4–20% |
| Sodium silicate | 5–30% |
| Polycarboxylates | 0–3% |
| Complexing agent phosphonate, citrate) | 0–35% |
| Enzymes: | |
| Durazym 6.0 T | 1–3% |
| Esperase 6.0 Tr | 1–3% |
| Savinase 6.0 T | 1–3% |
| Termamyl 60 T | 1–3% |
| Sodium sulphate, water, etc. | Balance to 100% |
| pH | 9.5–11.0 |

EXAMPLE 1

Myristoyl and lauroyl ED3A acids were neutralized with aqueous sodium hydroxide to produce a 20% wt. AI solution. The resulting sodium lauroyl ED3A and sodium myristoyl ED3A were used at a concentration of 0.2% wt. Ten grams of surfactant (20% wt. AI) were added to 990 grams of distilled deionized water to produce the 0.2% wt. solution.

One milliliter of protease enzyme (Savinase$^{3/4}$ 16.0 L type EX available commercially from Novo Nordisk) was diluted to 100 ml. with distilled deionized water. 1.43 ml of the enzyme solution was then added to four of five Tergotometer cells and allowed to acclimate for 20 minutes. The cell contents were as follows:

TABLE 1

| | Cell Contents |
|---|---|
| | Contents |
| Cell 1 | 0.2% wt sodium lauroyl ED3A |
| Cell 2 | 0.2% wt sodium myristoyl ED3A |
| Cell 3 | 0.00143% wt protease enzyme |
| Cell 4 | 0.2% wt sodium lauroyl ED3A & 0.00143% wt Protease enzyme solution |
| Cell 5 | 0.2% wt sodium myristoyl BD3A & 0.00143% wt Protease enzyme solution |

Cotton test swatches soiled with blood/ink/milk were placed in each cell and allowed to soak for 90 minutes. The tergotometer was activated and the swatches were washed for thirty minutes. After thirty minutes, the wash water was decanted. One liter of distilled, deionized water was then added to each cell and the cells were placed back into the tergotometer, which was then activated for 10 minutes. The water was then decanted and the test fabric was removed and placed on a piece of white cardboard. The fabric was allowed to air dry overnight.

Reflectance was measured using a photovolt detector with a detergent head and green filter. Four reflectance measurements were recorded for each test fabric, two measurements per side. Initial and final reflectance results are shown in Table 2. The difference in reflectance between the initial and final values are shown in Table 3. The change in reflectance due to enzyme activity is shown in Table 4.

TABLE 2

| | | Reflectance Values | | | | |
|---|---|---|---|---|---|---|
| Cell # | Swatch # | Position 1 | Position 2 | Position 3 | Position 4 | Average |
| | | Initial Values | | | | |
| 1 | 7 | 26.4 | 26.6 | 26.9 | 26.9 | 26.7 |
| 2 | 3 | 26.4 | 26.6 | 27.1 | 26.9 | 26.8 |
| 3 | 16 | 26.9 | 27.1 | 26.6 | 26.4 | 26.8 |
| 4 | 1 | 26.5 | 26.6 | 27.5 | 27.3 | 27.0 |
| 5 | 12 | 26.4 | 26.9 | 27.3 | 27.3 | 27.0 |
| 1 | 23 | 26.9 | 27.5 | 27.5 | 27.5 | 27.4 |
| 2 | 24 | 25.8 | 25.8 | 25.8 | 25.8 | 25.8 |
| 3 | 5 | 27.3 | 27.5 | 27.7 | 27.7 | 27.6 |
| 4 | 13 | 28.5 | 28.5 | 28.5 | 28.5 | 28.5 |
| 5 | 22 | 27.5 | 27.2 | 27.8 | 27.8 | 27.6 |
| | | Final Values | | | | |
| 1 | 7 | 61.4 | 61.6 | 61.6 | 61.8 | 61.6 |
| 2 | 3 | 60.5 | 60.5 | 60.7 | 60.5 | 60.6 |
| 3 | 16 | 58.9 | 58.9 | 58.5 | 59.3 | 58.9 |
| 4 | 1 | 74.2 | 74.4 | 74.4 | 74.6 | 74.4 |
| 5 | 12 | 73.5 | 73.7 | 74 | 73.7 | 73.7 |
| 1 | 23 | 62 | 62 | 62 | 62 | 62.0 |
| 2 | 24 | 59.1 | 59.7 | 59.3 | 59.3 | 59.4 |
| 3 | 5 | 60.1 | 59.7 | 59.7 | 58.9 | 59.6 |
| 4 | 13 | 74.8 | 74.8 | 74.8 | 74.4 | 74.7 |
| 5 | 22 | 72.9 | 73.5 | 73.3 | 73.3 | 73.3 |

TABLE 3

| | | | Delta Reflectance | | | |
|---|---|---|---|---|---|---|
| System | Cell # | Swatch # | Initial Average | Final Average | Delta Average | 2-Swatch Average |
| NaLED3A | 1 | 7 | 26.7 | 61.6 | 34.9 | |
| NaLED3A | 1 | 23 | 27.4 | 62.0 | 34.7 | 34.8 |

TABLE 3-continued

| | | | Delta Reflectance | | | |
|---|---|---|---|---|---|---|
| System | Cell # | Swatch # | Initial Average | Final Average | Delta Average | 2-Swatch Average |
| NaMED3A | 2 | 3 | 26.8 | 60.6 | 33.8 | |
| NaMED3A | 2 | 24 | 25.8 | 59.4 | 33.6 | 33.7 |
| Enzyme | 3 | 16 | 26.8 | 58.9 | 32.2 | |
| Enzyme | 3 | 5 | 27.6 | 59.6 | 32.1 | 32.1 |
| NaLED3A + Enzyme | 4 | 1 | 27.0 | 74.4 | 47.4 | |
| NaLED3A + Enzyme | 4 | 13 | 28.5 | 74.7 | 46.2 | 46.8 |
| NaMED3A + Enzyme | 5 | 12 | 27.0 | 73.7 | 46.8 | |
| NaMED3A + Enzyme | 5 | 22 | 27.6 | 73.3 | 45.7 | 46.2 |

TABLE 4

| Cell | Delta Due to Enzyme |
|---|---|
| 4-1 | 12.0 |
| 5-2 | 12.5 |

The results demonstrate the compatibility of N-acyl ED3A with protease enzyme. In addition, the presence of the N-acyl ED3A significantly enhanced the cleaning power of the enzyme system. The presence of the enzyme also enhanced the cleaning power of the surfactant solution (relative to the cleaning power of the surfactant solution alone), contributing an extra 12 points of brightness.

EXAMPLE 2

Myristoyl and oleoyl ED3A acids were neutralized with aqueous sodium hydroxide to produce a 20% wt. AI solution. In addition, a linear alkyl benzene sulfonate, namely, a 40% wt AI sodium dodecylbenzene sulfonate solution (Strepantan DS-40) was diluted with distilled deionized water to produce a 20% wt AI solution.

The aforementioned solutions, along with a solution of lauroyl ED3A, were evaluated at a concentration of 12.5% wt in a base detergent having the following formulation:

| | |
|---|---|
| zeolite A | 30.2 wt % |
| sodium carbonate | 20.8 wt % |
| sodium sulfate | 30.2 wt % |
| sodium silicate | 5.2 wt % |
| cmc | 1.0 wt % |

The overall detergent concentration tested was 3.5 grams of detergent/liter of water. Thus, the amount of dry detergent charged into each cell was 3.06 grams, whereas the amount of liquid surfactant charged to each cell was 2.18 grams (using 20% wt AI surfactant). The exact weights used are shown in Table 5 below:

TABLE 5

| | Surfactant | Surfactant Wt | Detergent Wt |
|---|---|---|---|
| Cell 1 | LABS | 2.1876 | 3.0615 |
| Cell 2 | NaMED3A | 2.1880 | 3.0634 |
| Cell 3 | NaOED3A | 2.1853 | 3.0634 |
| Cell 4 | LABS | 2.1887 | 3.0648 |

TABLE 5-continued

| | Surfactant | Surfactant Wt | Detergent Wt |
|---|---|---|---|
| Cell 5 | NaMED3A | 2.1890 | 3.0637 |
| Cell 6 | NaOED3A | 2.1860 | 3.0629 |

Enzyme was added to cells 4, 5, & 6

The surfactant portion of the detergent was added to each cell (containing one liter of distilled deionized water). The pH was adjusted to 8.3 with dilute NaOH. The remaining portion of the detergent was then added to the solution. The temperature of the solution in each cell was 48° C. and the pH was 10.5.

One milliliter of protease enzyme (Savinase$^{3/4}$ 16.0 L type EX available commercially from Novo Nordisk) was diluted to 100 ml. with distilled deionized water. 1.43 ml of the enzyme solution was then added to three of six Tergotometer cells and allowed to acclimate for 10 minutes.

Cotton test swatches soiled with blood/ink/milk were placed in each cell and the tergotometer was activated and the swatches were washed for thirty minutes. After thirty minutes, the wash water was decanted. One liter of distilled, deionized water was then added to each cell and the cells were placed back into the tergotometer, which was then activated for 10 minutes. The water was then decanted and the test fabric was removed and placed on a piece of white cardboard. The fabric was allowed to air dry overnight.

Reflectance was measured using a photovolt detector with a detergent head and green filter. Four reflectance measurements were recorded for each test fabric, two measurements per side. Initial and final reflectance results are shown in Table 6. The change in reflectance due to detergency is presented in Table 7. The change in reflectance due to enzyme activity is shown in Table 8.

TABLE 6

| | | Reflectance Values | | | | |
|---|---|---|---|---|---|---|
| Cell # | Cloth # | Position 1 | Position 2 | Position 3 | Position 4 | Average |
| | | Initial Values | | | | |
| 1 | 16 | 27 | 27.4 | 26.5 | 26.5 | 26.9 |
| 1 | 13 | 26.9 | 26.9 | 27.1 | 27.1 | 27.0 |
| 2 | 21 | 26.3 | 26.5 | 27.3 | 27.5 | 26.9 |
| 2 | 17 | 26.9 | 26.7 | 27.3 | 27.3 | 27.1 |
| 3 | 19 | 27.4 | 27.3 | 26.5 | 26.5 | 26.9 |
| 3 | 22 | 26.5 | 26.7 | 27.5 | 27.5 | 27.1 |
| 4 | 12 | 26.5 | 26.3 | 27.5 | 27.5 | 27.0 |
| 4 | 6 | 27.8 | 27.7 | 26.4 | 26.4 | 27.1 |
| 5 | 5 | 26.6 | 26.4 | 27.4 | 27.4 | 27.0 |
| 5 | 3 | 27.5 | 27.7 | 26.7 | 26.5 | 27.1 |
| 6 | 24 | 26.3 | 26.3 | 27.8 | 27.5 | 27.0 |
| 6 | 23 | 27.5 | 27.5 | 26.7 | 26.7 | 27.1 |
| | | After Wash | | | | |
| 1 | 16 | 75.4 | 75.4 | 75.2 | 75.4 | 75.4 |
| 1 | 13 | 75 | 75 | 75.2 | 75.4 | 75.2 |
| 2 | 21 | 65.7 | 65.9 | 65.9 | 66.1 | 65.9 |
| 2 | 17 | 69 | 68.8 | 68.8 | 68.8 | 68.9 |
| 3 | 19 | 71.1 | 71.1 | 71.1 | 71.1 | 71.1 |
| 3 | 22 | 70 | 69.6 | 69.8 | 69.6 | 69.8 |
| 4 | 12 | 74.4 | 74.4 | 74.6 | 74.8 | 74.6 |
| 4 | 6 | 76 | 76 | 76 | 76.2 | 76.1 |
| 5 | 5 | 70.2 | 70.2 | 70.2 | 70.4 | 70.3 |
| 5 | 3 | 71.1 | 71.5 | 71.3 | 71.3 | 71.3 |
| 6 | 24 | 71.5 | 71.7 | 71.3 | 71.5 | 71.5 |
| 6 | 23 | 72.9 | 72.9 | 73.7 | 73.3 | 73.2 |

TABLE 7

| | | Delta Reflectance | | | |
|---|---|---|---|---|---|
| Cell # | Cloth # | Initial Average | Final Average | Delta Average | 2-Swatch Average |
| 1 | 16 | 26.9 | 75.4 | 48.5 | |
| 1 | 13 | 27.0 | 75.2 | 48.2 | 48.3 |
| 2 | 21 | 26.9 | 65.9 | 39.0 | |
| 2 | 17 | 27.1 | 68.9 | 41.8 | 40.4 |
| 3 | 19 | 26.9 | 71.1 | 44.2 | |
| 3 | 22 | 27.1 | 69.8 | 42.7 | 43.4 |
| 4 | 12 | 27.0 | 74.6 | 47.6 | |
| 4 | 6 | 27.1 | 76.1 | 49.0 | 48.3 |
| 5 | 5 | 27.0 | 70.3 | 43.3 | |
| 5 | 3 | 27.1 | 71.3 | 44.2 | 43.8 |
| 6 | 24 | 27.0 | 71.5 | 44.5 | |
| 6 | 23 | 27.1 | 73.2 | 46.1 | 45.3 |

TABLE 8

| Change Due to Enzyme | |
|---|---|
| Cell # | Delta Reflectance |
| 4-1 | 0.0 |
| 5-2 | 3.3 |
| 6-3 | 1.9 |

The linear alkylbenzene sulfonate deactivated the enzyme completely, and there was no increase in brightness between systems 1 and 4. However, systems 5 and 6 produced significantly higher values than systems 2 and 3. In the case of myristoyl ED3A, the presence of the enzyme increased brightness by 3.3 points. The n-acyl ED3A was compatible with the enzyme.

What is claimed is:

1. A detergent composition containing (a) 0.001% to 3% of a protease enzyme and (a) 5% to 35% of a salt of N-acyl ethylenediaminetriacetic acid, wherein said acyl group is a straight or branched aliphatic or aromatic group containing from 1 to 40 carbon atoms.

2. The detergent composition of claim 1, wherein said acyl group contains from 8 to 18 carbon atoms.

3. The detergent composition of claim 1, wherein said salt of N-acyl ethylenediaminetriacetic acid is an alkali metal salt.

4. The detergent composition of claim 1, wherein said salt of N-acyl ethylenediaminetriacetic acid is an alkanol amine salt.

5. The detergent composition of claim 1, wherein said salt of N-acyl ethylenediaminetriacetic acid is an amino alcohol salt.

6. The detergent composition of claim 1, wherein said acyl group is selected from the group consisting of lauroyl, oleoyl and myristoyl.

7. The detergent composition of claim 6, wherein said acyl group is lauroyl.

8. The detergent composition of claim 1, further comprising a builder.

* * * * *